US008937560B2

(12) United States Patent
Seabury

(10) Patent No.: US 8,937,560 B2
(45) Date of Patent: Jan. 20, 2015

(54) VEHICLE DETECTION TWO-WIRE MAGNETIC FIELD SENSING PROBE WITH COMMUNICATION CAPABILITY

(71) Applicant: Diablo Controls, Inc., Pleasanton, CA (US)

(72) Inventor: Thomas W. Seabury, Nevada City, CA (US)

(73) Assignee: Diablo Controls, Inc., Pleasanton, CA (US)

( * ) Notice: Subject to any disclaimer, the term of this patent is extended or adjusted under 35 U.S.C. 154(b) by 194 days.

(21) Appl. No.: 13/777,135

(22) Filed: Feb. 26, 2013

(65) Prior Publication Data

US 2014/0239945 A1 Aug. 28, 2014

(51) Int. Cl.
*G08B 21/00* (2006.01)
*G08G 1/042* (2006.01)

(52) U.S. Cl.
CPC ..... *G08G 1/042* (2013.01)
USPC ..... 340/933; 340/941

(58) Field of Classification Search
USPC ..... 340/933, 941, 942, 943; 701/1
See application file for complete search history.

(56) References Cited

U.S. PATENT DOCUMENTS

D290,707 S 7/1987 Allen et al.
4,731,867 A 3/1988 Seabury et al.
4,996,716 A 2/1991 Potter et al.
5,089,815 A 2/1992 Potter et al.
5,198,811 A 3/1993 Potter et al.
5,247,297 A 9/1993 Seabury et al.
6,087,964 A 7/2000 Allen et al.
7,132,959 B2 11/2006 Seabury et al.

OTHER PUBLICATIONS

M-GAGE Q7M Flat-Pak Vehicle Detection Sensor; Banner; pp. 1-8; P/N 117172 Rev.D, Oct. 30. 2012.
Three-Axis Digital Compass IC HMC5883L; pp. 1-19; Form #900405 Rev C; Apr. 2012.

*Primary Examiner* — Jeffery Hofsass
(74) *Attorney, Agent, or Firm* — Miller, Matthias & Hull LLP

(57) ABSTRACT

A system of communicating vehicle detection is provided. The system may include a probe having at least a probe controller and a magnetic sensor for detecting the Earth's magnetic fields, and a control system having a main controller, an output port and a two-wire interface for communicating with the probe. The probe controller may be configured to quantify detected magnetic fields into a sensor output value per iteration at a predefined frequency, and initiate an interrupt per iteration the sensor output value is determined to exceed a predefined sensor value. The main controller of the control system may be configured to communicate a supply signal to the probe over a first line of the two-wire interface, monitor a return signal from the probe over a second line of the two-wire interface for interrupts, and generate a call signal on the output port indicative of confirmed vehicle detection if the number of consecutive interrupts in the return signal exceed a predefined interrupt limit.

20 Claims, 8 Drawing Sheets

VEHICLE DETECTION TWO-WIRE MAGNETIC FIELD SENSING PROBE WITH COMMUNICATION CAPABILITY

TECHNICAL FIELD

The present disclosure generally relates to vehicle detection schemes, and more particularly, to systems and methods for communicating vehicle detection information over simplified wired interfaces.

BACKGROUND

Various detection schemes are used on a daily basis to detect the presence or passing of vehicles for aiding in the control of traffic signal systems, traffic monitoring systems, gated access systems, and many other related applications. For instance, when used in association with monitoring traffic, vehicle detection systems detect the presence and/or passing of vehicles on roadways and/or intersections thereof to determine traffic conditions, detect common congestion areas, and the like. For gated access applications, vehicle detection systems use the detected presence of a vehicle to automatically deny or allow access therethrough. While currently existing schemes may adequately detect vehicles with some accuracy, there is still room for improvement.

One commonly used approach to vehicle detection employs induction loops or coils that are installed beneath the surface of the pavement or roadway and designed to detect the presence or the passing of vehicles thereover. More particularly, an electric current is supplied through the induction coil at fixed frequencies to generate a predefined inductance. Due to the mostly metallic body of vehicles, when a vehicle is positioned over an induction loop, it induces eddy currents which further vary the inductance in the coils. By monitoring or detecting these deviations in inductance, the vehicle detection system is able to determine whether a vehicle has passed over an induction loop or is standing over the induction loop, and the like.

However, induction loop systems are extremely costly to implement and maintain. Specifically, the installation of induction loop systems entails a great amount of labor just to cut the appropriate grooves within the pavement for the induction coils. The process further involves inserting the inductions coils within the grooves as well as patching the grooves with material sufficient to withstand changing weather conditions and protect the coils from other forms of contamination. While the installation process alone is labor-intensive and costly, such drawbacks are further compounded by the need to shutdown one or more lanes of traffic per installation of an induction loop system and for the full duration thereof.

Other more recent developments employ magnetic sensor-based schemes to detect passing or standing vehicles. These systems generally rely on a magnetometer or related magnetic sensors which detect the direction and magnitude of surrounding magnetic fields, or the Earth's magnetic fields, along one or more axes. Typically, a magnetometer probe is placed above ground but proximate to the anticipated travel path of a vehicle, beneath the surface of the pavement, or in any other position suitable for detecting changes in the Earth's magnetic fields or interference caused by vehicles passing or standing thereby. However, many magnetic sensor-based systems generally employ wireless means of communication, such as radio-frequency, or the like, between the probe and the control box associated therewith, which introduces a vast array of undesirable interference. More particularly, changing weather conditions, surrounding structures, and many other environmental factors can adversely affect the wireless transmission of probe data, and thus, the overall consistency and reliability of the vehicle detection system.

Accordingly, there is a need for a cost-efficient, simplified, and yet reliable means of detecting vehicle proximity as well as communicating such detection data between a probe and a control system associated therewith. Moreover, there is a need for vehicle detection systems and methods which reduce susceptibility to interference from environmental surroundings, while also reducing the overall costs associated with implementation, control and maintenance thereof. The present disclosure is directed at addressing one or more of the deficiencies set forth above.

SUMMARY OF THE DISCLOSURE

In one aspect of the present disclosure, a system of communicating vehicle detection is provided. The system may include a probe having at least a probe controller and a magnetic sensor for detecting the Earth's magnetic fields, and a control system having a main controller, an output port and a two-wire interface for communicating with the probe. The probe controller may be configured to quantify detected magnetic fields into a sensor output value per iteration at a predefined frequency, and initiate an interrupt per iteration the sensor output value is determined to exceed a predefined sensor value. The main controller of the control system may be configured to communicate a supply signal to the probe over a first line of the two-wire interface, monitor a return signal from the probe over a second line of the two-wire interface for interrupts, and generate a call signal on the output port indicative of confirmed vehicle detection if the number of consecutive interrupts in the return signal exceed a predefined interrupt limit.

In another aspect of the disclosure, a system of communicating vehicle detection is provided. The system may include at least one multi-axis magnetic sensor for detecting the Earth's magnetic fields, and a control system having a controller, an output port and a two-wire interface for communicating with the magnetic sensor. The controller may be configured to quantify changes in one or more magnetic fields as detected by each axis of the magnetic sensor into a sensor output value per iteration at a predefined frequency, initiate an interrupt per iteration the sensor output value exceeds a predefined sensor limit, communicate a supply signal to the magnetic sensor over a first line of the two-wire interface, monitor a return signal from the magnetic sensor over a second line of the two-wire interface for interrupts, and generate a call signal indicative of confirmed vehicle detection if the number of consecutive interrupts in the return signal exceed a predefined interrupt limit.

In yet another aspect of the disclosure, a method of communicating vehicle detection over a two-wire interface is provided. The method may include the steps of quantifying changes in the Earth's magnetic fields as detected by each axis of a multi-axis magnetic sensor into a sensor output value per iteration at a predefined frequency, initiating an interrupt per iteration the sensor output value exceeds a predefined sensor limit, communicating a supply signal to the magnetic sensor over a first line of the two-wire interface, monitoring a return signal from the magnetic sensor over a second line of the two-wire interface for interrupts, and generating a call signal indicative of confirmed vehicle detection if the number of consecutive interrupts exceed a predefined interrupt limit.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
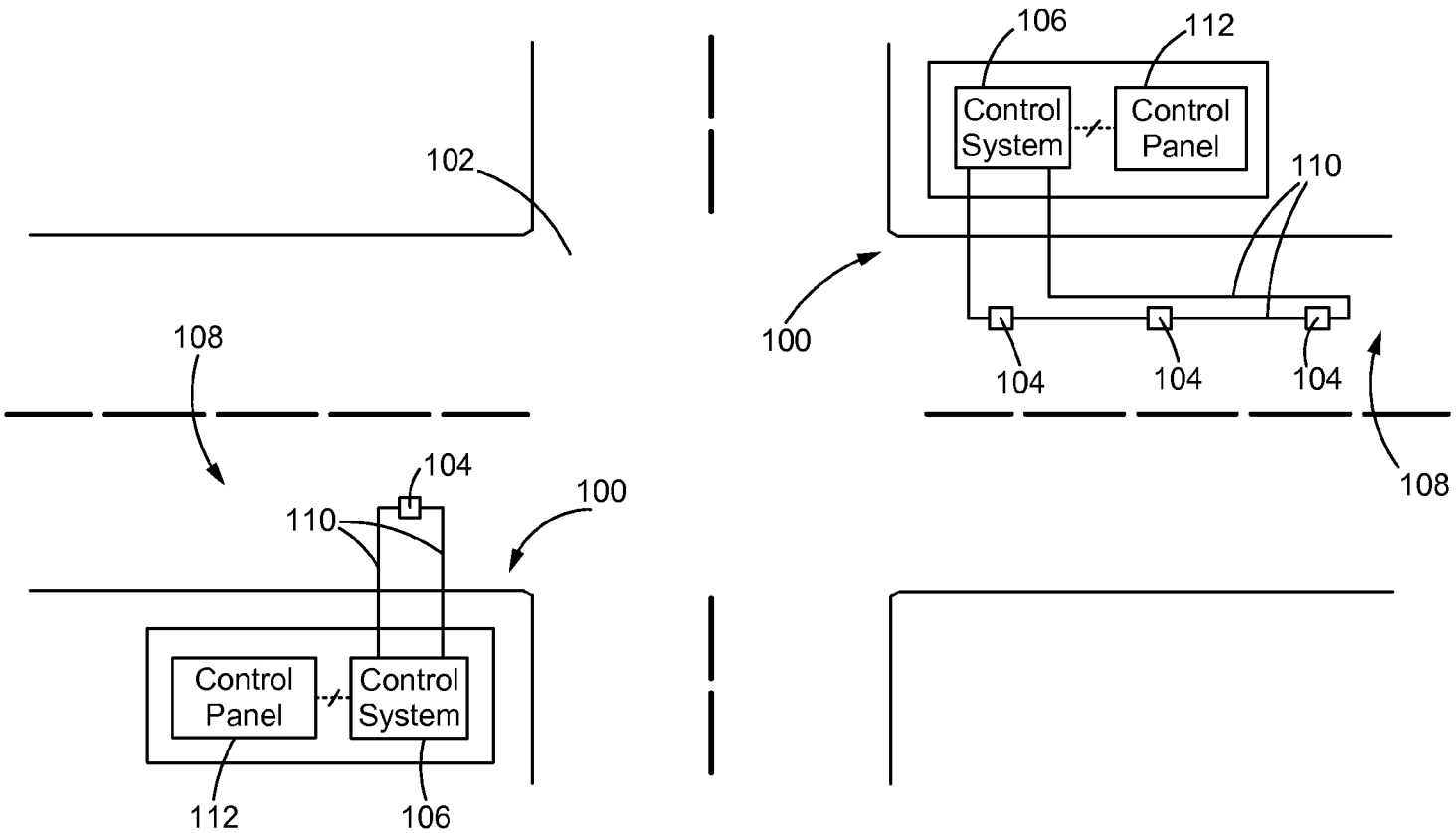
FIG. 1 is a diagrammatic view of exemplary vehicle detection communication systems that are implemented at an intersection and constructed in accordance with the teachings of the present disclosure.

FIG. 1 diagrammatically illustrates various configurations for implementing one exemplary communication system 100 for vehicle detection, for example, at an intersection 102. As shown, the system 100 may be generally comprised of one or more probes 104 which are installed at desired points along a vehicle roadway, and a control system 106 positioned and configured to communicate with each of the probes 104. More specifically, as shown in the bottom left quadrant of the intersection 102 of FIG. 1, a single probe 104 may be positioned approximately along the center of the corresponding lane 108, or in any other suitable position most likely to detect vehicles passing thereby. The probe 104 may be installed at least partially beneath the surface of the pavement and placed in wired, electrical communication with the control system 106. Moreover, the probe 104 and the control system 106 may communicate over a simplified two-wire interface 110 as shown which may advantageously require only minimal road work for installation, removal, maintenance, and the like.

Similarly, as shown in the upper right quadrant of the intersection 102 of FIG. 1, the communication system 100 may also be configured to employ a plurality of probes 104 that are connected in a series configuration along the corresponding lane 108 and distanced a predefined length apart from one another. Such a configuration may enable the control system 106 to detect one or more vehicles over a greater length of a given lane, while still minimizing the road work required for installation or implementation thereof. For example, the communication system 100 may be configured such that the same two-wire interface 110 may be used even when more than one probe 104 is needed. In further modifications, the control system 106 as well as the two-wire interface 110 may be configured to be easily adaptable for use with any number of probes 104. While only certain embodiments and configurations of the communication system are depicted in the accompanying drawings, it will be understood that other modifications will be apparent to those skilled in the art without departing from the scope of the appended claims.

In such a way, each of the probes 104 in FIG. 1 may continuously or periodically monitor the magnetic fields along the respective lanes 108 at the intersection 102 for any significant change detected therein which may be, for example, indicative of a passing or standing vehicle. In particular, the probes 104 may track the magnitude and/or the direction of the magnetic fields along one or more axes, and communicate detected interference in the magnetic fields through the two-wire interface 110 to the control system 106 for further analysis. In general, the control system 106 may observe the information provided by the probes 104 and assess whether the detected changes are sufficiently indicative of a vehicle that is passing along or standing within the corresponding lane 108. If the control system 106 determines that a vehicle is present within or passing through a lane 108, the control system 106 may further communicate such information to an associated control panel or box 112. The control box 112 may be representative of any controller system requiring vehicle detection information, such as for the purposes of controlling traffic signal systems, monitoring traffic conditions, automating gated access systems, or the like.

Figure 2:
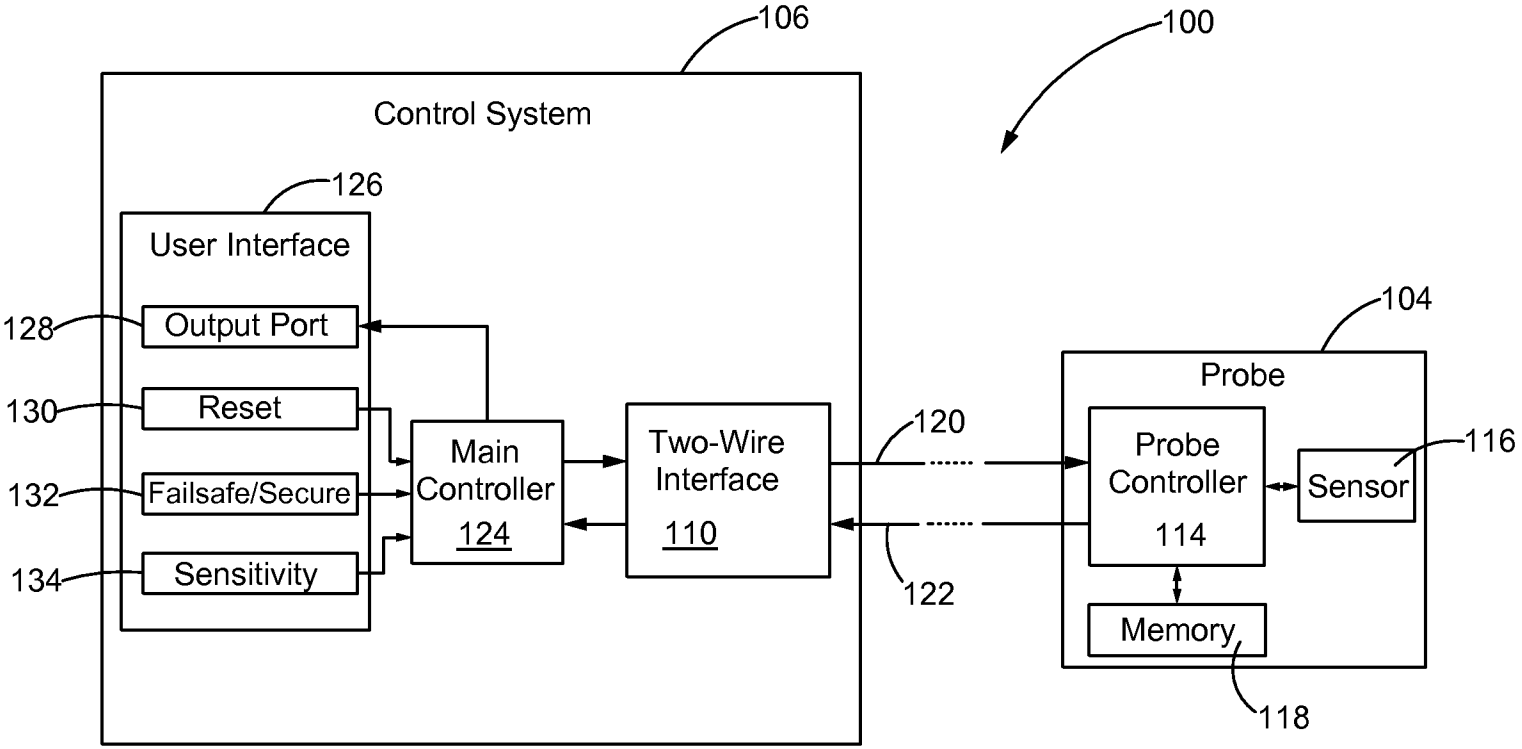
FIG. 2 is a schematic view of one exemplary vehicle detection communication system comprising a control system and a probe coupled thereto over a two-wire interface.

Turning now to FIG. 2, one exemplary embodiment of a communication system 100 is provided generally having a control system 106 and at least one probe 104 coupled thereto via a two-wire interface 110. More particularly, the probe 104 may include at least one probe controller 114, at least one magnetic sensor 116 and a memory 118 that is accessible to the probe controller 114. The probe controller 114 may be implemented using any one or more of a processor, a microprocessor, a microcontroller, a digital signal processor (DSP), a field-programmable gate array (FPGA), or any other comparable device for operatively and electrically communicating with at least the magnetic sensor 116. Moreover, the probe controller 114 may be preprogrammed to operate according to an algorithm or a sequence of code providing instructions for performing one or more predefined tasks.

Furthermore, the magnetic sensor 116 of FIG. 2 may be a multi-axis magnetic sensor or a magnetometer, such as a three-axis magnetometer, or the like, that is capable of detecting the magnitude and/or direction of the Earth's magnetic fields about one or more of its axes, X-axis, Y-axis and Z-axis, and quantifying the magnetic field data into one or more digitally readable values, or at least values recognizable by the associated probe controller 114. The memory 118 in FIG. 2 may be a nonvolatile memory, or the like, that is capable of at least temporarily and retrievably storing any digitally readable data relevant to the magnetic field data. The memory 118 may be disposed on-board the probe controller 114, locally disposed relative to the probe 104, situated at the control system 106, or provided in any other form that is accessible to at least the probe controller 114. During typical use, the probe controller 114 may generally read the magnetic field data detected by the magnetic sensor 116, compare the detected magnetic field data with predefined baseline or reference data retrieved from the memory 118, and communicate any significant changes in the magnetic field data to the control system 106 over one or more of the first and second lines 120, 122 of the two-wire interface 110.

Still referring to FIG. 2, the control system 106 may generally include a main controller 124, a two-wire interface 110 and a user interface 126. More particularly, the main controller 124 may be configured to communicate with the probe 104 via the two-wire interface 110, and further, may be configured to communicate with a user, such as an installer, a technician, an operator, an administrator, or the like, via the user interface 126. The main controller 124 may additionally or alternatively communicate with one or more control panels or boxes 112 associated therewith via the user interface 126. Similar to the probe controller 114, the main controller 124 may be implemented using any one or more of a processor, a microprocessor, a microcontroller, a digital signal processor (DSP), a field-programmable gate array (FPGA), or any other comparable device for operatively and electrically communicating with at least the probe 104 over the two-wire interface 110. As with the probe controller 114, the main controller 124 may be preprogrammed to operate according to an algorithm or a sequence of code providing instructions for performing one or more predefined tasks. In other modifications, more than one controller may be provided at the probe 104 and/or at the control system 106. In still further modifications, the communication system 100 may be implemented using a single controller for centrally managing operations of both the probe 104 and the control system 106.

As shown in FIG. 2, the user interface 126 may provide an output port 128, such as in the form of a closure of a relay, or the like, through which the main controller 124 may transmit electrical signals indicative of vehicle detection information to an external source, such as a user or a control panel or box 112 connected thereto. The user interface 126 may additionally provide inputs, such as a reset input port 130, a failsafe/security input port 132, a sensitivity adjustment port 134, and/or any other necessary or desirable control input. More specifically, the reset input 130 may enable the control system 106 or at least the probe 104 to perform a system reset and any calibrations or initialization procedures as needed, for example, upon a new installation, maintenance work, repair work, or the like. Furthermore, the reset input 130 may be configured to be engageable only when there is no vehicle and/or other comparable metallic object within a predefined range, for example, approximately 30 to 50 feet, of the probe 104 being reset. In addition, the reset input 130 may take the form of a push-button, switch, or the like, and further, may be electrically engaged remotely, automatically and/or manually by a user, technician, or the like.

The failsafe/security switch 132 of FIG. 2 may be similarly engaged remotely, automatically and/or manually by a user to configure the main controller 124 to operate according to the failsafe/security setting desired by the user. In particular, the failsafe/security switch 132 may be provided in the form of a toggle switch, or the like, which may configure the communication system 100 to default to either a failsafe mode of operation or a security mode of operation when there is a malfunction or fault condition. When used in conjunction with a gated access system, for example, the failsafe setting may instruct the main controller 124 to err on the side of keeping the gate lifted and preventing damage to passing vehicles during a fault condition until the fault is cleared. Thus, the failsafe setting may be selected when, for instance, the potential loss of revenue or theft resulting from a lifted gate is less significant than the potential damage to passing vehicles and other setbacks caused by a closing or a closed gate. Alternatively, the security setting may instruct the main controller 124 to err on the side of keeping the game closed and preventing potential loss of revenue or theft during a fault condition until the fault is cleared. Thus, the security setting may be selected when, for instance, the potential loss of revenue or theft resulting from a lifted gate is more significant than the potential damage to passing vehicles and other setbacks caused by a closing or a closed gate. Additionally or optionally, the sensitivity input 134 may be provided in the form of one or more dials, switches, or the like, enabling a user to remotely, automatically and/or manually configure the overall sensitivity of the control system 106, as will be discussed in more detail further below.

Figure 3:
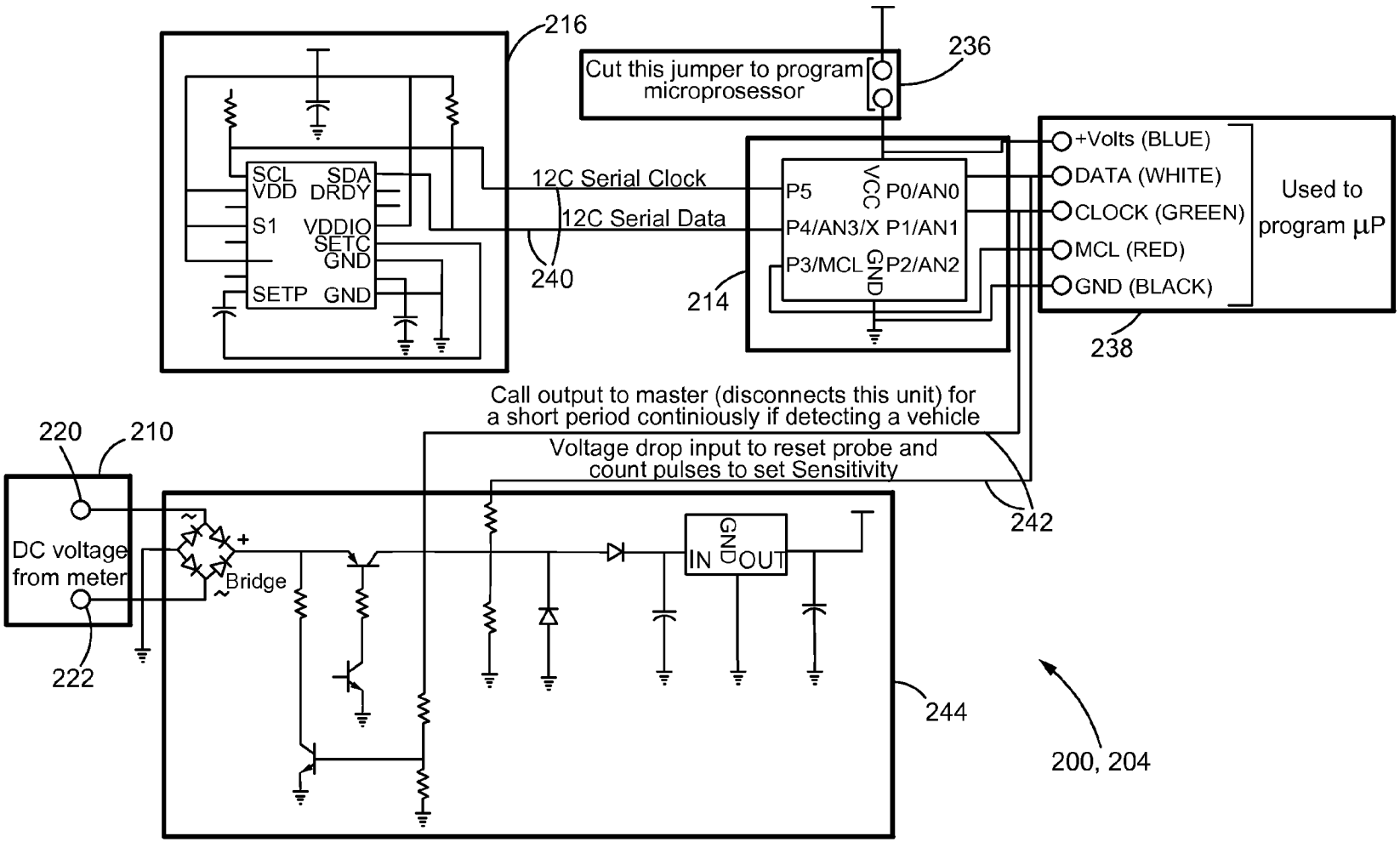
FIG. 3 is a schematic view of one exemplary probe of a vehicle detection communication system.
Figure 4:
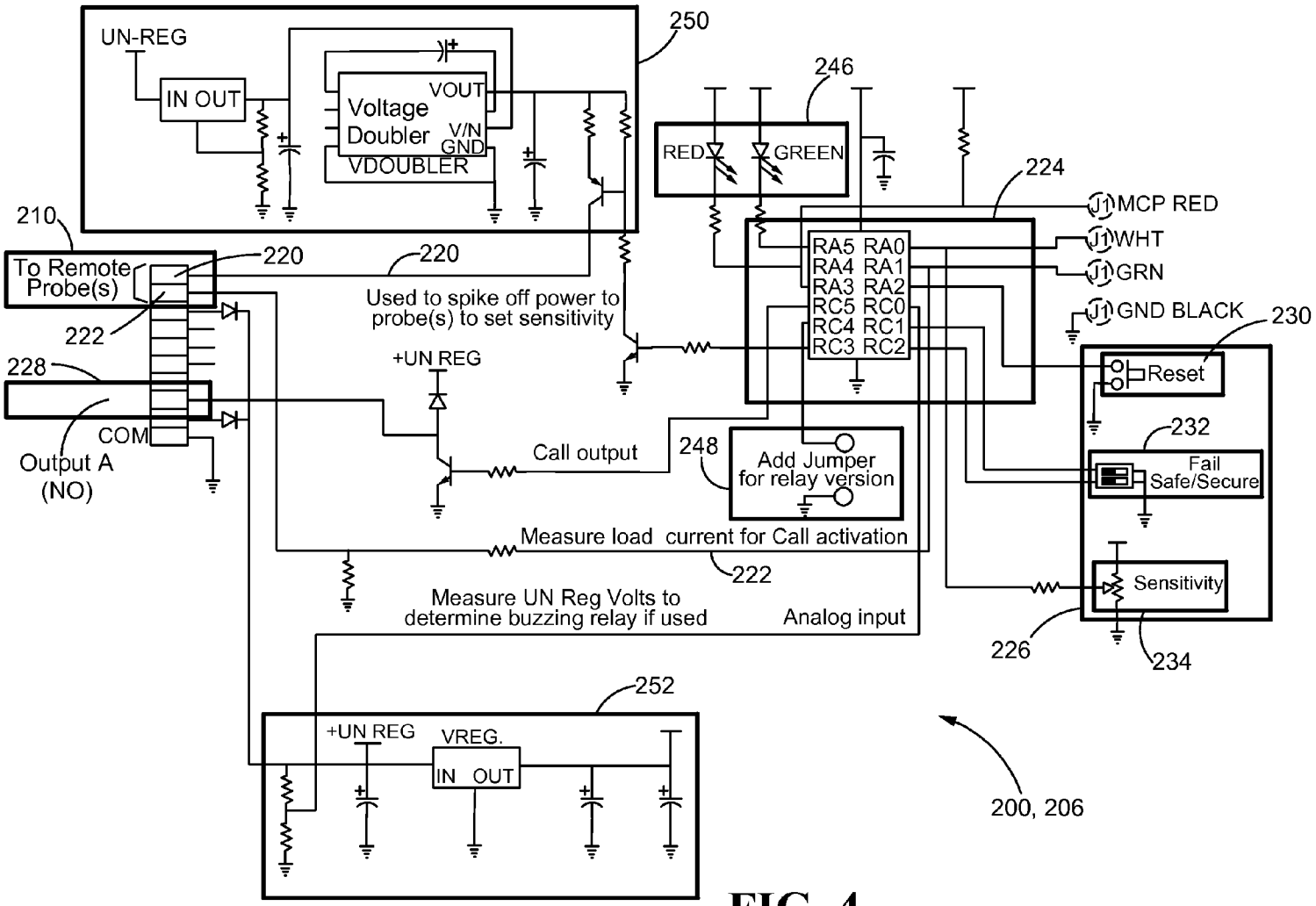
FIG. 4 is a schematic view of one exemplary control system of a vehicle detection communication system.

Referring to FIGS. 3-4, another exemplary embodiment of a communication system 200 is provided in more detail. As in the previous embodiments of FIGS. 1-2, the communication system 200 may include a probe 204, as shown for example in FIG. 3, which communicates with a control system 206, as shown for example in FIG. 4, over a two-wire interface 210. Although the communication system 200 of FIGS. 3-4 provides only one probe 204 in communication with the control system 206, it will be understood that the control system 206 may also communicate with a plurality of probes 204 that are connected in series relative to one another. As demonstrated by the embodiment in the upper right quadrant of FIG. 1 for example, a plurality of series-connected probes 204, distanced a predefined length apart from one another along a corresponding lane, may communicate with the single control system 206 over the same two-wire interface 210.

As shown in FIG. 3, the probe 204 may include at least one probe controller 214 and at least one multi-axis magnetic sensor or magnetometer 216 electrically and operatively coupled thereto. The probe controller 214 in FIG. 3 may be implemented using a microcontroller that is programmable to operate and interface with the magnetometer 216 according to an algorithm or a predetermined sequence of code or instructions for performing one or more predefined tasks. In the embodiment of FIG. 3, for example, a jumper 236 may be selectively and temporarily enabled to place the probe controller 214 into a programming mode of operation, during which the probe controller 214 may be programmed via select inputs 238 thereof.

The probe controller 214 of FIG. 3 may communicate with the magnetometer 216 via two or more sensor lines 240 carrying, for example, serial clock information, serial data information, or any other information pertaining to the detected magnetic fields surrounding the magnetometer 216. The magnetic field information collected from the magnetometer 216 may then be at least partially processed by the probe controller 214 to be applied toward calibration, initialization, vehicle detection, or any other related task, prior to communicating the magnetic field information through the two-wire interface 210 and to the control system 206. For example, based on the selected mode of operation and the magnetic field information observed, the probe controller 204 may be programmed to initiate an interrupt to be communicated to the control system 206, such as indicating possible detection of a vehicle, through one or more of the probe controller lines 242. Similarly, the probe controller 214 may be programmed to adjust a sensitivity of the magnetometer 216 in response to voltage drops, interrupts, or other signal variants, received through one or more of the probe controller lines 242, as will be discussed in more detail further below.

In addition, the probe 204 of FIG. 3 may include supporting circuitry 244 disposed between the two-wire interface 210 and the probe controller 214 to appropriately condition any output signals in the probe controller lines 244 being transmitted to the control system 206 from the probe controller 214, as well as any input signals being transmitted to the probe controller 214 from the control system 206 through the two-wire interface 210. More specifically, the supporting circuitry 244 may provide means for rectifying voltage to the probe controller 214, means for regulating voltage to the probe controller 214, and the like. As shown in FIG. 3, for example, the supporting circuitry 244 may provide a bridge rectifier that is advantageously configured to enable appropriate power to the probe controller 214 regardless of the polarity of the two-wire interface 210 coupled thereto.

As in previous embodiments, the control system 206 of FIG. 4 may similarly include a main controller 224, the two-wire interface 210 and a user interface 226. More particularly, the main controller 224 may be configured to communicate with the probe 204 via the first and second lines 220, 222 of the two-wire interface 210, and further, may be configured to communicate with a user, or the like, via the user interface 226. As with the probe controller 214, the main controller 224 may be implemented using a microcontroller or any other comparable device for operatively and electrically communicating with at least the probe 204 over the two-wire interface 210. Moreover, the main controller 224 may be preprogrammed to operate according to an algorithm or a sequence of code providing instructions for performing one or more predefined tasks.

As shown in FIG. 4, the user interface 126 may provide inputs, such as a push-button reset 230, a failsafe/security switch 232, a sensitivity adjustment input 234, and/or any other necessary or desirable control input. More specifically, the push-button reset 230 may enable the control system 206 or at least engage the probe 204 to perform a system reset and any calibrations or initialization procedures as needed, for example, upon a new installation, maintenance work, repair work, or the like. Furthermore, the reset input 230 may be configured to be engageable only when there is no vehicle and/or other comparable metallic object within a predefined range, for example, approximately 30 to 50 feet, of the probe 204 being reset. Additionally, the push-button reset 230 may alternatively take the form of a switch, a dial, or the like, and further, may be electrically engaged remotely, automatically and/or manually by a user, or the like. The failsafe/security switch 232 may be provided in the form of a toggle switch, or the like, that is engageable remotely, automatically and/or manually by a user to configure the main controller 224 to, during fault conditions, operate according to a failsafe setting or a security setting desired by the user. Specifically, the failsafe setting may configure the communication system 200 to err on the side of persistently signaling the existence of a vehicle during a fault condition, and the security setting may configure the communication system 200 to err on the side of persistently signaling the lack of a vehicle during a fault condition. Additionally or optionally, the sensitivity input 234 may be provided in the form of one or more dials, switches, or the like, enabling a user to remotely, automatically and/or manually configure the overall sensitivity of the control system 206. Still further, the control system 206 may provide an output port 228, such as in the form of a closure of a relay, or the like, through which the main controller 224 may transmit electrical signals indicative of vehicle detection information to an external source, as will be discussed in more detail further below.

In addition to components previously provided by the control system 106 of FIGS. 1-2, the control system 206 of FIG. 4 may provide one or more light-emitting diodes (LEDs) 246 configured to provide indications of the operational status of the control system 206 and/or the main controller 224, or the like. Similar to the probe controller 214, the control system 206 may also provide a jumper 248 selectively enabling the main controller 224 to be placed into a programming mode of operation. Still further, the control system 206 may include supporting circuitry 250, 252 configured to appropriately adjust or condition any electrical signals traveling to or from the main controller 224. When supplying power to a plurality of series-connected probes 204 with a single control system 206, for example, a voltage booster 250, such as a voltage doubler, or the like, may be used to boost or compensate the voltage in the supply signal being carried through the first line 220 of the two-wire interface 210 and transmitted to the probe 204 from the main controller 224. However, if a fewer number of series-connected probes 204, or a single probe 204 configuration is being employed, the control system 206 may not need a voltage booster 250 at all. The control system 206 may additionally provide a voltage regulator 252, a current controller, and/or any other suitable means for maintaining consistent power to each of the connected probes 204 irrespective of any changes in the connected load or the number of probes 204 attached. For example, the supporting circuitry 250, 252 may be configured such that power supplied to each probe 204 within a multi-probe confirmation, such as a four-probe configuration, is unaffected when one or more of the probes 204 are removed. Conversely, the supporting circuitry 250, 252 may additionally be configured such that power supplied to a probe 204 in a single-probe configuration also is unaffected when one or more probes 204 are added in series thereto.

Figure 5:
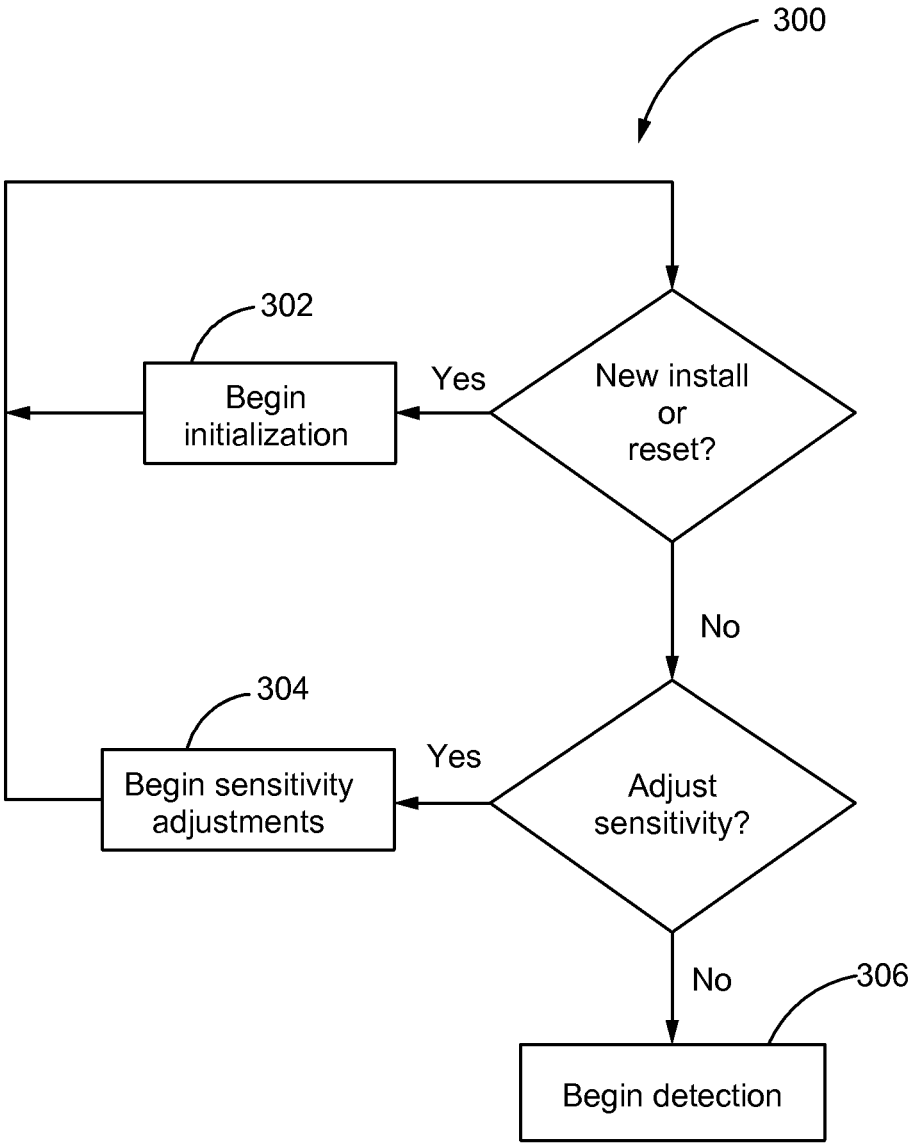
FIG. 5 is a flow diagram of one exemplary algorithm or method of selecting a mode of operation of a vehicle detection communication system.

One or more of the probe controllers 114, 214 and the main controllers 124, 224 of the communication systems 100, 200 of FIGS. 2-4 may be preprogrammed according to the overall control scheme 300 of FIG. 5, and more particularly, configured to operate according to any one or more of the predetermined algorithms or methods 302, 304, 306 shown. Each algorithm, or set of instructions, may be preprogrammed or incorporated into memory that is disposed within the respective controller 114, 124, 214, 224 or is otherwise accessible by the controller 114, 124, 214, 224. For example, the main controller 224 may be preprogrammed and configured to selectively operate the control system 206 in any one or more of an initialization mode of operation 302, a sensitivity adjustment mode of operation 304, a detection mode of operation 306, or the like. As will be discussed in more detail further below, the main controller 224 may select the appropriate mode of operation 302, 304, 306 based on one or more conditionals preprogrammed therein. In other modifications, the main controller 224 may also be capable of performing more than one of the modes of operation 302, 304, 306 simultaneously, such as enabling the sensitivity adjustment mode of operation 304 while operating in the detection mode of operation 306, or the like. In addition, other possible modes of operation and combinations thereof, as well as other suitable control schemes therefor will be apparent to those skilled in the art.

Still referring to the overall control scheme 300 of FIG. 5, the main controller 224 may be configured to begin an initialization process 302 to be executed by the probe controller 214 if a reset command is engaged, either automatically or manually. An initialization process 302 may be appropriate where, for example, a new magnetometer 216 has been installed and/or if the physical orientation of an existing magnetometer 216 has been changed. A user may manually engage the initialization process 302, for example, by engaging the push-button reset 230 of the control system 206 of FIG. 4. The reset input 230 to the main controller 224 may also be electrically engaged, for instance, by a remote user with appropriate administrative authority to access the control system 206, to initialize any one or more of the attached magnetometers 216. Additionally, the probe controller 214 and/or the main controller 224 may be preprogrammed to automatically perform a reset, or an initialization process 302, at predefined intervals of time, for example, every year or as otherwise desired.

Figure 6:
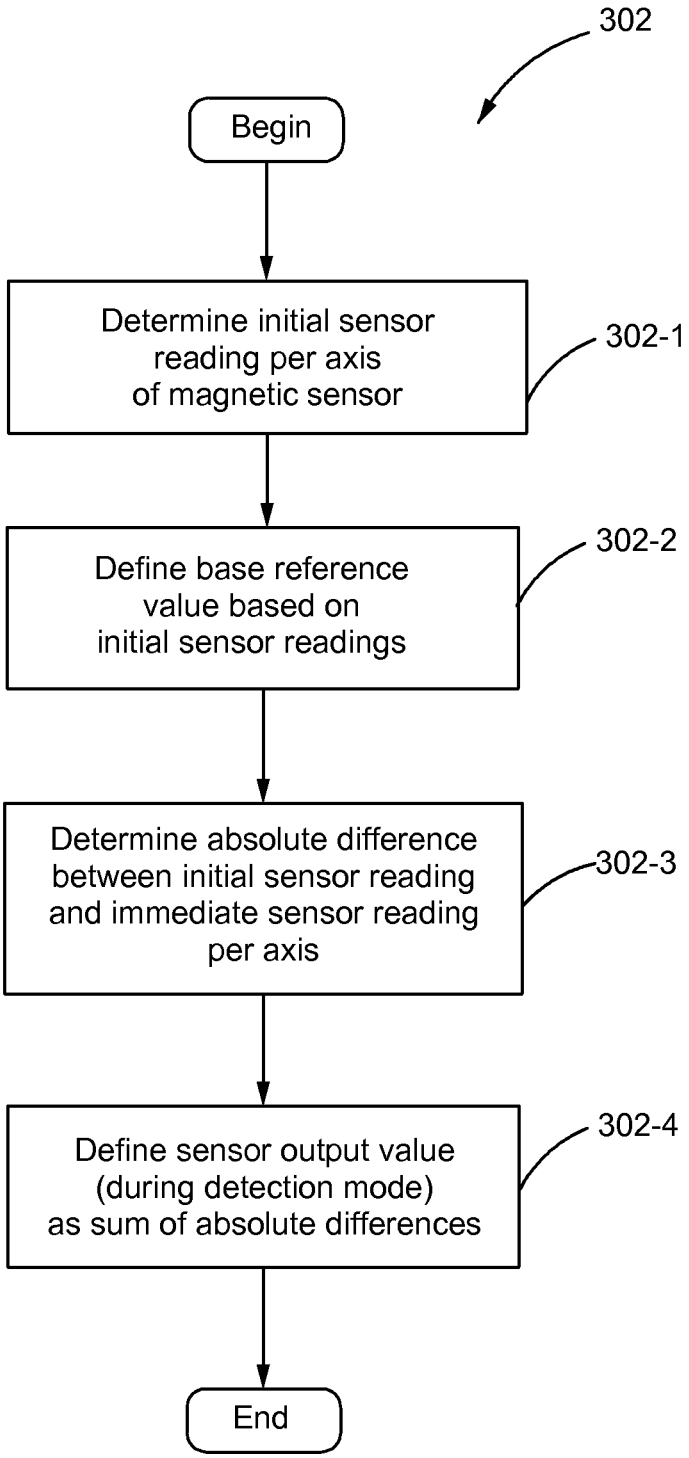
FIG. 6 is a flow diagram of one exemplary algorithm or method of operating a vehicle detection communication system in an initialization mode.

If such a reset is engaged and the initialization mode of operation 302 is desired, the main controller 224 may be configured to instruct the probe controller 214 to operate according to the method 302 shown in FIG. 6 for example. As shown in step 302-1, the probe controller 214 may initially be configured to determine the initial sensor reading per axis of a particular magnetometer 216. In a three-axis magnetometer 216 for example, the probe controller 214 may determine the initial magnitude and direction of the magnetic fields as detected by each of the three perpendicular axes, X-axis, Y-axis and Z-axis, of the magnetometer 216. In step 302-2, the probe controller 214 may further be configured to retrievably store these initial sensor readings designated as base reference values in nonvolatile memory, or the like. In one possible implementation, the probe controller 214 may individually store each of the initial sensor readings taken per axis of the magnetometer 216, X-axis, Y-axis and Z-axis, as a set of base reference values corresponding to each of the three axes, X-axis, Y-axis and Z-axis. In other alternative modifications, the probe controller 214 may also quantify the individual initial sensor readings taken per axis, X-axis, Y-axis and Z-axis, of the magnetometer 216 into a single base reference value to be retrievably stored in memory.

Once the base reference values have been determined, the probe controller 214 in step 302-3 of FIG. 6 may be programmed to quantify future sensor readings based on a comparison to the base reference values. More specifically, the probe controller 214 may be configured such that, upon taking a new or immediate sensor reading, the probe controller 214 determines an absolute difference between the initial sensor reading, or the base reference value, and the immediate sensor reading per axis of the magnetometer 216. For each of the three axes, X-axis, Y-axis and Z-axis, of the magnetometer 216 for example, the probe controller 214 may calculate the absolute difference between the stored base reference value and the new or immediate sensor reading to result in three absolute difference values, one for each of the three axes, X-axis, Y-axis and Z-axis. Once an absolute difference value is calculated for each of the axes of the multi-axis magnetometer 216, the probe controller 214 may be configured to define a single, combined sensor output value based on the absolute difference values in step 302-4. For example, the probe controller 214 may be configured to simply calculate the sum of the three absolute difference values taken from a three-axis magnetometer 216 and designate the sum as the single sensor output value for that particular iteration. In such a way, the probe controller 216 may be capable of reliably assessing detected changes in the Earth's magnetic fields irrespective of the physical orientation of the magnetometer 216 upon initial install.

Figure 7:
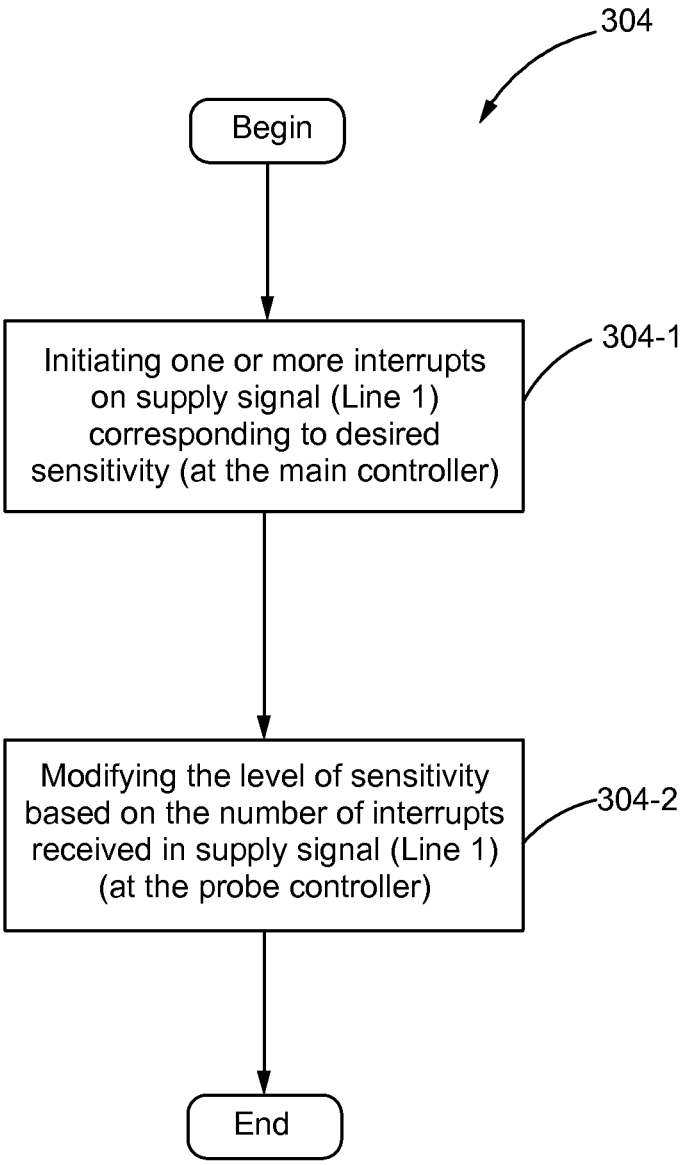
FIG. 7 is a flow diagram of one exemplary algorithm or method of operating a vehicle detection communication system in a sensitivity adjustment mode.

Referring back to method 300 of FIG. 5, the main controller 224 may also be configured to determine if the sensitivity of the attached magnetometers 216 requires adjustment, and if so, begin such a mode of operation 304 as shown for example in FIG. 7. Sensitivity adjustments may be performed upon a new installation and/or upon calibration of a probe 204. Moreover, the sensitivity adjustment mode of operation 304 may be performed to modify the level of sensitivity with which the magnetometer 216 assesses changes in the magnitude and/or direction of the Earth's magnetic fields. The appropriate level of sensitivity to which a magnetometer 216 is set may vary according to the environment within which the probe 204 is to be installed or other factors. For example, the sensitivity may be set to relatively lower settings if the magnetometer 216 is installed in areas with little to very light traffic, while the sensitivity may be set to relatively higher settings if the magnetometer 216 is installed in areas with moderate to heavier levels of traffic. The level of sensitivity may also be adjusted to compensate for any devices, objects, structures, or the like, that may be situated in relatively close proximity the probe 204 sufficient to affect the probe's ability to detect vehicles. The level of sensitivity may be manually adjusted by an on-site user or electrically adjusted by a remote user, for example, through the sensitivity control input 234 of FIG. 4. By enabling adjustment of the sensitivity of the magnetometer 216, the probe 204 and control system 206 may improve the overall accuracy of the probe 204 and help reduce the number of false detection alerts.

If the main controller 224 of the control system 206 is instructed, manually or automatically, to adjust the sensitivity thereof, the main controller 224 may proceed to adjust the sensitivity according to, for example, the method 304 of FIG. 7. Specifically, the main controller 224 may be configured to initiate one or more interrupts on the supply signal that is transmitted to the probe 204, for example, through the first line 220 of the two-wire interface 210. More particularly, the main controller 224 may engage one or more switches within the control system 206 to spike off or cut power in the supply signal to the probe 204 to cause an interrupt that is detectable by the probe controller 214 within the probe 204. The number of interrupts caused by the main controller 224, as well as the frequency of the interrupts which occur within a predefined period of time, may directly correspond to the desired level of sensitivity to be set by the probe controller 214. Correspondingly, at the probe 204, the supporting circuitry 244 may receive the interrupts in the supply signal through the first line 220 of the two-wire interface 210, and communicate the interrupts to an input of the probe controller 214. The probe controller 214 may be configured to adjust the level of sensitivity based on the number of interrupts that are detected within a predefined duration of time. For example, in a configuration which recognizes sensitivity levels, i.e., ranging between 0 and 6, the main controller 224 may initiate 3 interrupts, each approximately 50 microseconds apart, to instruct the probe controller 214 to set the sensitivity to level 3.

Figure 8:
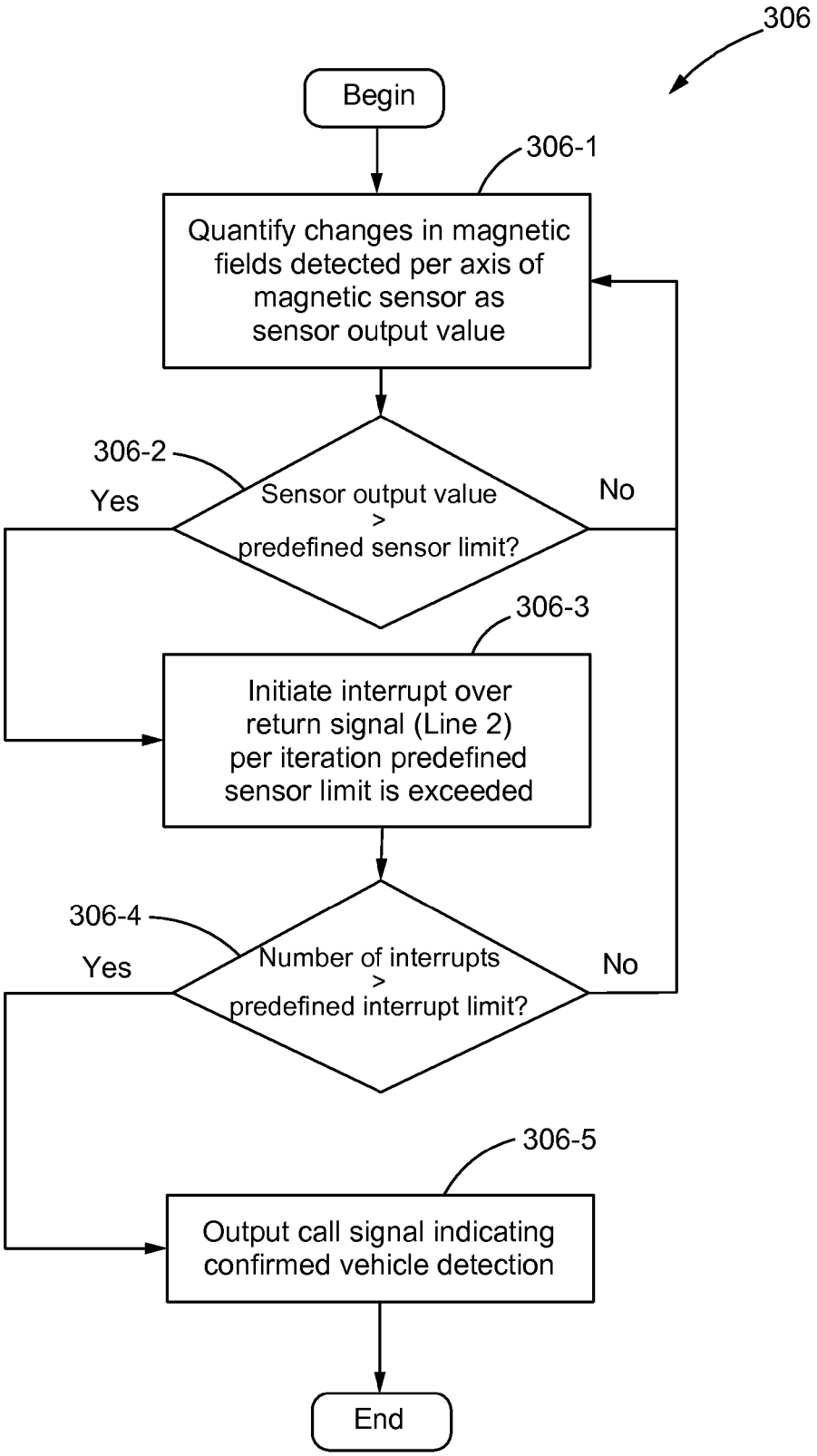
FIG. 8 is a flow diagram of one exemplary algorithm or method of operating a vehicle detection communication system in a detection mode.

With reference again to the method 300 of FIG. 5, the main controller 224 may be configured to initiate a detection mode of operation 306, as shown in FIG. 8 for example, if there is no need for either a reset or a sensitivity adjustment. In particular, the main controller 224 may instruct the probe controller 214 to begin detecting changes in the Earth's magnetic fields using the magnetic sensor or magnetometer 216. In response, as shown in step 306-1 of FIG. 8, the probe controller 214 may be configured to quantify any changes in the magnitude and/or direction of the magnetic fields as detected per axis, such as detected each of along X-axis, Y-axis and Z-axis, by the magnetometer 216. Any existing changes in the magnetic fields may be quantified as a sensor output value, for example, according to a sum of absolute difference values calculated with respect to base reference values as previously discussed with respect to the initialization mode of operation 302 of FIG. 6. In step 306-2, the probe controller 214 may additionally compare the sensor output value with a predefined sensor limit to determine whether the detected change in the magnetic fields sufficiently corresponds to that typically caused by a passing vehicle or a vehicle standing in proximity to the magnetometer 216. The predefined sensor limit may be defined as a sum of the base reference value, determined during the initialization mode of operation 302, and a preset sensitivity value programmed into the probe controller 214. For example, the preset sensitivity value may directly correspond to the sensitivity level programmed during the sensitivity adjustment mode of operation 304 of FIG. 7.

Still referring to FIG. 8, if the sensor output value is determined to be less than or equal to the predefined sensor limit for a particular iteration, the probe controller 214 may simply return to step 306-1 to proceed to the next iteration and continue detecting for changes in the Earth's magnetic fields. Alternatively, if the sensor output value is determined to exceed the predefined sensor limit, the probe controller 214 may be configured to initiate one or more interrupts to be communicated to the control system 206 over the return signal in step 306-3 to signal magnetic interference potentially indicative of vehicle detection. Moreover, the probe controller 214 may engage one or more switches within the probe 204 to disconnect the return signal of the second line 222 of the two-wire interface 210 for a predefined frequency, for a predefined duration of time and/or for each iteration the sensor output value is determined to exceed the predefined sensor limit, to cause an interrupt that is detectable by the main controller 224 of the control system 206. The duration of the interrupt and/or the number of interrupts caused by the probe controller 214 may directly correspond to the magnitude and/or duration of the magnetic interference, the proximity of the vehicle causing the interference, the speed of the vehicle causing the interference, or the like. Correspondingly, at the control system 206, the main controller 224 may receive the interrupts in the return signal through the second line 222 of the two-wire interface 210, and determine whether the number and/or duration of interrupts received exceed a predefined interrupt limit in step 306-4.

If the number and/or duration of interrupts received by the main controller 224 during step 306-4 of FIG. 8 does not exceed the predefined interrupt limit, the main controller 224 may deem that the magnetic interference detected was not sufficient to signal the presence, passing or an otherwise noticeable detection of a vehicle as desired by the user, and to proceed to the next iteration and continue detecting for subsequent changes in the Earth's magnetic fields in step 306-1. If, however, the number and/or duration of interrupts received by the main controller 224 during step 306-4 exceeds the predefined interrupt limit, the main controller 224 may proceed to step 306-5 and output a call signal indicating a confirmed detection of one or more vehicles. More specifically, the main controller 224 may be preprogrammed to generate the call signal at the output port 228, and communicate the call signal through the user interface 226 to an associated control panel or box 112 or any other associated system requiring vehicle detection information, such as for the purposes of controlling traffic signal systems, monitoring traffic conditions, automating gated access systems, or the like. Once a call signal is appropriately generated, the probe controller 214 and the main controller 224 may return to step 306-1 to proceed to the next iteration and continue detecting for subsequent changes in the Earth's magnetic fields.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A system of communicating vehicle detection, comprising:

a probe having at least a probe controller and a magnetic sensor for detecting the Earth's magnetic fields, the probe controller being configured to quantify detected magnetic fields into a sensor output value per iteration at a predefined frequency, and initiate an interrupt per iteration the sensor output value is determined to exceed a predefined sensor value; and a control system having a main controller, an output port and a two-wire interface for communicating with the probe, the main controller being configured to communicate a supply signal to the probe over a first line of the two-wire interface, monitor a return signal from the probe over a second line of the two-wire interface for interrupts, and generate a call signal on the output port indicative of confirmed vehicle detection if the number of consecutive interrupts in the return signal exceed a predefined interrupt limit.

2. The system of claim 1, wherein the magnetic sensor is a multi-axis magnetic sensor configured to quantify the Earth's magnetic fields in terms of direction and magnitude per axis thereof.

3. The system of claim 1, wherein the magnetic sensor is a three-axis magnetometer configured to quantify the Earth's magnetic fields in terms of direction and magnitude as detected by each axis thereof, each axis being perpendicular to one another.

4. The system of claim 1, wherein the probe controller, in an initialization mode of operation, is configured to:

determine an initial sensor reading of the magnetic fields as measured by each axis of the magnetic sensor upon initial install or reset, and define a base reference value corresponding to the initial sensor readings to be retrievably stored in a memory accessible to the probe controller.

5. The system of claim 4, wherein the probe controller, in a detection mode of operation, is configured to:

determine an absolute difference between the initial sensor reading and an immediate sensor reading per axis of the magnetic sensor, and define the sensor output value as a sum of the absolute differences to be compared with the base reference value.

6. The system of claim 4, wherein the predefined sensor value is comprised of the base reference value and a preset sensitivity value, the preset sensitivity value corresponding to a desired degree of sensor sensitivity to changes in the magnetic fields.

7. The system of claim 4, wherein the probe further includes nonvolatile memory within which the base reference value is retrievably stored.

8. The system of claim 1, wherein the control system further includes a user interface providing one or more of a manual reset button, a failsafe/security switch, and a sensitivity switch.

9. The system of claim 1, wherein the control system is configured to communicate with a plurality of probes disposed in series relative to one another.

10. A system of communicating vehicle detection, comprising:

at least one multi-axis magnetic sensor for detecting the Earth's magnetic fields; and a control system having a controller, an output port and a two-wire interface for communicating with the magnetic sensor, the controller being configured to quantify changes in the magnetic fields as detected by each axis of the magnetic sensor into a sensor output value per iteration at a predefined frequency, initiate an interrupt per iteration the sensor output value exceeds a predefined sensor limit, communicate a supply signal to the magnetic sensor over a first line of the two-wire interface, monitor a return signal from the magnetic sensor over a second line of the two-wire interface for interrupts, and generate a call signal indicative of confirmed vehicle detection if the number of consecutive interrupts in the return signal exceed a predefined interrupt limit.

11. The system of claim 10, wherein the controller is further configured to adjust the predefined sensor limit by initiating one or more interrupts on the supply signal over the first line of the two-wire interface, the number of interrupts corresponding to different sensitivity settings.

12. The system of claim 10, wherein the controller, in an initialization mode of operation, is further configured to:

determine an initial sensor reading of the magnetic fields as measured by each axis of the magnetic sensor upon initial install or reset, define a base reference value corresponding to the initial sensor readings to be retrievably stored in a memory accessible to the controller, determine an absolute difference between the initial sensor reading and an immediate sensor reading for each axis of the magnetic sensor, and define the sensor output value as a sum of the absolute differences for all axes of the magnetic sensor to be compared with the base reference value.

13. The system of claim 12, wherein the controller determines the predefined sensor limit based on the base reference value and a preset sensitivity value, the preset sensitivity value corresponding to a desired degree of sensor sensitivity to changes in the magnetic fields.

14. The system of claim 12, wherein the controller is configured to initialize the magnetic sensor upon any one or more of an installation of the magnetic sensor, a manual reset and an automated reset.

15. The system of claim 10, wherein the control system is in electrical communication with a plurality of multi-axis magnetic sensors connected in series relative to one another, the control system maintaining communication with each of the plurality of multi-axis magnetic sensors through a single two-wire interface.

16. A method of communicating vehicle detection over a two-wire interface, the method comprising the steps of:

quantifying changes in the Earth's magnetic fields as detected by each axis of a multi-axis magnetic sensor into a sensor output value per iteration at a predefined frequency;

initiating an interrupt per iteration the sensor output value exceeds a predefined sensor limit;

communicating a supply signal to the magnetic sensor over a first line of the two-wire interface;

monitoring a return signal from the magnetic sensor over a second line of the two-wire interface for interrupts; and generating a call signal indicative of confirmed vehicle detection if the number of consecutive interrupts exceed a predefined interrupt limit.

17. The method of claim 16, wherein the predefined sensor limit is adjusted by initiating one or more interrupts on the supply signal over the first line of the two-wire interface, the number of interrupts corresponding to different sensitivity settings.

18. The method of claim 16, further comprising the initialization steps of:

determining an initial sensor reading of the magnetic fields as measured by each axis of the magnetic sensor upon initial install or reset;

defining a base reference value corresponding to the initial sensor readings to be retrievably stored in a memory;

determining an absolute difference between the initial sensor reading and an immediate sensor reading for each axis of the magnetic sensor; and defining the sensor output value as a sum of the absolute differences for all axes of the magnetic sensor to be compared with the base reference value.

19. The method of claim 18, wherein the predefined sensor limit is determined based on the base reference value and a preset sensitivity value, the preset sensitivity value corresponding to a desired degree of sensor sensitivity to changes in the magnetic fields.

20. The method of claim 18, wherein the initialization steps are performed upon any one or more of an installation of the magnetic sensor, a manual reset and an automated reset.

* * * * *